US009902541B2

(12) United States Patent
Cheema et al.

(10) Patent No.: US 9,902,541 B2
(45) Date of Patent: Feb. 27, 2018

(54) PACKAGING

(71) Applicant: Cadbury Holdings Limited, Uxbridge, Middlesex (GB)

(72) Inventors: Parbinder Cheema, Bournville (GB); Jason Denis Willey, Bournville (GB)

(73) Assignee: Mondelez UK Holdings & Services Limited, Uxbridge (GB)

( * ) Notice: Subject to any disclaimer, the term of this patent is extended or adjusted under 35 U.S.C. 154(b) by 593 days.

(21) Appl. No.: 13/858,168

(22) Filed: Apr. 8, 2013

(65) Prior Publication Data

US 2013/0224346 A1 Aug. 29, 2013

Related U.S. Application Data

(63) Continuation of application No. 13/637,390, filed as application No. PCT/GB2011/050602 on Mar. 24, 2011, now abandoned.

(30) Foreign Application Priority Data

Mar. 30, 2010 (GB) ..... 1005354.4

(51) Int. Cl.
*B65D 65/22* (2006.01)
*B65B 11/00* (2006.01)
*B65D 75/58* (2006.01)

(52) U.S. Cl.
CPC ..... *B65D 65/22* (2013.01); *B65B 11/004* (2013.01); *B65D 75/5844* (2013.01)

(58) Field of Classification Search
CPC .... B65D 75/66; B65D 75/68; B65D 33/2533; B65D 33/2583; B65D 77/32
USPC ..... 229/87.01, 87.05, 87.08
See application file for complete search history.

(56) References Cited

U.S. PATENT DOCUMENTS

| | | | | | |
|---|---|---|---|---|---|
| 2,952,395 | A | * | 9/1960 | Spees | 383/205 |
| 2,991,001 | A | * | 7/1961 | Hughes | 383/210.1 |
| 3,127,087 | A | * | 3/1964 | Spees | 383/205 |
| 3,217,969 | A | * | 11/1965 | Hans-Jurgen | 229/239 |
| 3,266,965 | A | * | 8/1966 | Spees | 156/152 |
| 3,446,632 | A | * | 5/1969 | Le Van Wayne | 426/107 |
| 3,873,018 | A | * | 3/1975 | Donnay | 215/256 |
| 4,629,071 | A | * | 12/1986 | Tani | 383/206 |

(Continued)

FOREIGN PATENT DOCUMENTS

| | | | |
|---|---|---|---|
| GB | 2172545 A | * | 9/1986 |
| GB | 2441320 | * | 5/2006 |
| WO | 97/01495 A1 | | 1/1997 |

*Primary Examiner* — Peter Helvey
(74) *Attorney, Agent, or Firm* — Hoffmann & Baron, LLP

(57) ABSTRACT

A package (10) is formed from a flexible laminated wrapper (14) having an outer laminate structure (26) and an inner laminate structure (24) and includes a tear strip (30) formed in the wrapper. The tear strip has an outer tear strip portion (40) defined between a pair of outer spaced lines of weakness (42, 44) in the outer laminate structure. At least one inner line of weakness (48, 50) is formed in the inner laminate structure offset from the outer lines of weakness. At least a part (54) of the tear strip defined in one of the outer and inner laminate structures is bonded to an overlapping region of the other of the outer and inner laminate structures in a peelable manner. An inner tear strip portion (46) may be defined in the inner laminate structure (24) between a pair of spaced inner lines of weakness (48, 50).

14 Claims, 5 Drawing Sheets

(56) References Cited

U.S. PATENT DOCUMENTS

| | | | | | |
|---|---|---|---|---|---|
| 4,650,079 | A * | 3/1987 | Tani | 383/206 | |
| 4,773,541 | A * | 9/1988 | Riddell | 229/235 | |
| 5,035,328 | A * | 7/1991 | Kim | 229/238 | |
| 5,035,329 | A * | 7/1991 | Kim | 229/238 | |
| 5,116,140 | A * | 5/1992 | Hirashima | 383/206 | |
| 5,203,634 | A * | 4/1993 | Kim | 383/205 | |
| 5,782,733 | A * | 7/1998 | Yeager | 493/213 | |
| 5,823,933 | A * | 10/1998 | Yeager | 493/213 | |
| 5,836,697 | A * | 11/1998 | Chiesa | 383/205 | |
| 5,954,433 | A * | 9/1999 | Yeager | 383/203 | |
| 6,224,262 | B1 * | 5/2001 | Hogan et al. | 383/203 | |
| 6,354,739 | B1 * | 3/2002 | Sheehan et al. | 383/205 | |
| 7,395,642 | B2 * | 7/2008 | Plourde et al. | 53/412 | |
| 7,717,620 | B2 * | 5/2010 | Hebert | B29C 59/007 | 383/116 |
| 7,722,255 | B2 * | 5/2010 | Tessera Chiesa | 383/205 | |
| 7,744,131 | B2 * | 6/2010 | Urbanek | 283/81 | |

* cited by examiner

PACKAGING

CROSS-REFERENCE TO RELATED APPLICATIONS

This application is a continuation application of U.S. patent application Ser. No. 13/637,390, filed Sep. 26, 2012; which is the National Stage of International Application No. PCT/GB2011/050602, which designates the U.S., filed Mar. 24, 2011, which claims the benefit of Great Britain Application No. GB 1005354.4 filed Mar. 30, 2010, the contents of which are incorporated by reference herein.

TECHNICAL FIELD OF THE INVENTION

The present invention relates to packaging, and in particular, but not exclusively, to packaging for food and more specifically confectionery products.

BACKGROUND TO THE INVENTION

It is known to package food products such as chocolate bars and other snack type confectionery products in a packet which is formed from a wrapper of flexible material. Such known wrappers may be in the form of a length of flat, foldable material having an inner surface directed to the food product and an outer surface. The outer surface may be printed on or otherwise be provided with information for the consumer. In some processes, the wrapper is supplied as part of a continuous roll or film of wrappers.

One known packaging arrangement is commonly referred to as a flow-wrap packet. This type of packet is produced using a flow-wrap method in which a film of material is supplied in a roll to package a number of products in a substantially continuous process and is often used to package generally blocked shaped products such as chocolate or other confectionery bars and the like. However, the arrangement can be modified to package products of a different shape or to package a stack or array of smaller products positioned side-by-side.

In the flow-wrap method, the material is fed through a machine which folds it about each product or each stack of products in turn so that opposing longitudinal side edges are brought into contact and bonded together to form a longitudinal fin or lap seal. The material is usually crimped at either end of the product or stack to form end seals and the material is cut to separate each package from the remainder of the film. The seals may be formed using an adhesive to bond the opposing surfaces of the wrapper or by heating the material under pressure so that the opposing surfaces melt and fuse together to form a welded seal.

It is also known to package a number of products arranged in an array or stack by folding a wrapper around the stack and securing the wrapper in the folded condition to form a tubular packet. The wrapper is folded circumferentially about the stack so that one longitudinal edge of the wrapper overlaps the other longitudinal edge and is held in place by means of adhesive or otherwise bonded to form a longitudinal seal. The wrapper is longer than the stack and the protruding ends of the wrapper are folded to form tabs in an overlapping arrangement to close the ends of the packet. The end closure tabs can be adhered to one another so that the wrapper forms a sealed packet for the products. This type of packaging is used for a variety of consumable products such as biscuits and confectionery items including gum pellets, mints, gums, hard boiled sweets, candies, chocolates, toffee and the like.

For either type of packaging, suitable wrappers can be made from a variety of materials including polymeric materials, metallic foil, and paper. Often the wrapper will be formed as a laminate having two or more layers of different materials. For packaging confectionery products, a commonly used laminate comprises an inner layer of paper and an outer layer of a metallic, often aluminium, foil. However, other materials can be used including polymeric materials which may include thermoplastic materials such as polyethylene terephthalate (PET), for example. Depending on the types of materials used, the known wrappers can be used to form a fully sealed packet which is substantially gas and moisture impervious. However, for some food and confectionery applications, a hermitically sealed packet is not desirable.

A problem with the known wrappers is that the material used is typically quite tough. This makes opening the packet difficult as the material does not easily tear in a controlled fashion. To assist a consumer in gaining access to the packaged products, it is common practice to provide a tear guide in or on the wrapper which assists a consumer in tearing the packet along a predetermined line. Often the tear guide will be positioned so that it circumscribes the packet at or close to one end so that after tearing, an end region of the packet can be fully or partially removed to allow access to the product(s).

One known form of tear guide comprises a separate strip of material which is attached to an inner surface of the wrapper. The strip is made of a material which is stronger than the wrapper and an end of the strip is exposed in the finished packet so that it can be grasped by a user and pulled to tear the wrapper along the line of the strip. Use of a separate tear strip is disadvantageous as it requires the manufacture and storage of an additional component, i.e. the strip, as well as an additional process step of applying the strip to the wrapper. Where packets are formed from a roll of material in a continuous process, such as with flow-wrapped packets, the strip of material is often applied to the material as part of the packaging process. However, in order to apply the strip, the machinery must be run at speeds which are significantly lower than the maximum speed that could otherwise be achieved. This is especially so where the strip is applied in a transverse direction of the material. This reduces the efficiency of the packaging process and so leads to an increase in costs.

To overcome these drawbacks, it is known to form one or more lines of weakness in the wrapper to act as a tear guide. Lines of weakness can be formed by means of perforations which extend through the wrapper but this is not suitable where the product is perishable as the integrity of the sealed packet is lost. Alternatively, score lines can be formed which extend only partway through the thickness of the material. Where the wrapper is a laminate, it is known to provide a line of weakness which extends through only one or some of the layers so that at least one layer is left intact to maintain the integrity of the packet prior to opening. This arrangement though is not always satisfactory as the layer(s) which is/are left intact may still be difficult to tear in a controlled manner.

It is also known to package products, including food and confectionery products, in a packet in the form of a carton made from a thin, flexible laminated board such as a laminated cartonboard or cardboard or the like. In order to make opening of the carton easier, lines of weakness can be formed in the board to defining an opening region. However, particularly where the products are food products, such as confectionery products, it is desirable that the lines of weakness do not destroy the integrity of the packet before the packet is opened but yet are configured so that it is easy for all consumers, including children and the elderly to open. It is also desirable that packaging is this nature is reclosable or resealable.

It is an object of the invention to provide an improved packaging which overcomes or at least mitigates the above problems.

It is a further object of the invention to provide an improved packaging material which overcomes or at least mitigates the above problems.

It is a still further object of the invention to provide an improved method of packaging which overcomes or at least mitigates the above problems.

SUMMARY OF THE INVENTION

In accordance with a first embodiment of the invention, there is provided a package assembly comprising one or more products and a packet enclosing the one or more products, the packet being formed from a laminated material having an outer laminate structure and an inner laminate structure, the packet having an opening arrangement comprising a tear strip formed in the laminated material, the tear strip having an outer tear strip portion defined in the outer laminate structure between a pair of outer spaced lines of weakness in the outer laminate structure and at least one inner line of weakness in the inner laminate structure which is offset from the outer lines of weakness, at least part of the tear strip defined in one of the outer and inner laminate structures being bonded to an overlapping region of the other of the outer and inner laminate structures in a peelable manner.

The material may be a flexible laminated wrapper or film.

The material may be a laminated board, such as paperboard, cartonboard, cardboard, or the like.

The at least a part of the tear strip may be bonded to the overlapping region of the inner laminate structure by means of a peelable adhesive. The peelable adhesive may be a re-sealable adhesive.

In one arrangement, the opening arrangement comprises only a single inner line of weakness in the inner laminate structure, the inner line of weakness being located between the spaced outer lines of weakness, the outer tear strip portion being bonded to an underlying region of the inner laminate structure in a peelable manner.

In an alternative arrangement, the tear strip comprises an inner tear strip portion defined in the inner laminate structure between two spaced inner lines of weakness in the inner structure. Each of the inner lines of weakness substantially follows the path of a corresponding one of the outer lines a weakness and at least one of the inner lines of weakness is offset relative to its corresponding outer line of weakness.

The outer tear strip portion may be bonded to the inner tear strip portion, in which case the bond strength between the inner outer tear strip portions is stronger than peelable bond between said at least part of the tear strip defined in one of the outer and inner laminate structures and the overlapping region of the other of the outer and inner laminate structures. In one embodiment, peelable adhesive is used to bond said at least part of the tear strip defined in one of the outer and inner laminate structures and the overlapping region of the other of the outer and inner laminate structures in a peelable manner and a permanent adhesive used to bond the inner and outer laminate structures together elsewhere. In another embodiment, the inner and outer laminate structures are bonded together using single adhesive, the adhesive being patterned to provide the different required bond strengths. The adhesive may be a permanent adhesive, a peelable/resalable adhesive or cold seal.

The outer tear strip portion may not be bonded to the inner tear strip portion, in which case the outer lines of weakness only extend partway through the outer laminate structure.

One of the outer and inner tear strip portions may have a longitudinal edge region which projects in a lateral direction of the tear strip beyond a corresponding longitudinal edge of the other of the outer and inner tear strip portions to define a longitudinal edge region which overlaps a portion of one of the outer and inner laminate structures, the longitudinal edge region being bonded to the overlapping portion of said one of the outer and inner laminate structures in a peelable manner.

The inner tear strip portion may be narrower than the outer tear strip portion, the outer tear strip portion having at least one longitudinal edge region which projects beyond a corresponding longitudinal edge of the inner tear strip portion, and the at least one longitudinal edge region may be bonded to an underlying portion of the inner laminate structure in a peelable manner. Both longitudinal edges of the outer tear strip portion project may beyond the corresponding longitudinal edges of the inner tear strip portion to define longitudinal edge regions on either side of the tear strip, in which case, both longitudinal edge regions may be bonded to respective underlying portions of the inner laminate structure in a peelable manner.

The inner tear strip portion may be wider than the outer tear strip portion, the inner tear strip portion having at least one longitudinal edge region which projects beyond a corresponding longitudinal edge of the outer tear strip portion, and the at least one longitudinal edge region may be bonded to an overlying portion of the outer laminate structure in a peelable manner. Both longitudinal edges of the inner tear strip portion may project beyond the corresponding longitudinal edges of the outer tear strip portion to define longitudinal edge regions on either side of the outer tear strip, in which case both longitudinal edge regions may be bonded to respective overlying portions of the outer laminate structure in a peelable manner.

The inner tear strip portion may be partially offset to one side of the outer tear strip portion so that a longitudinal edge of the outer tear strip portion projects beyond a corresponding longitudinal edge of the inner tear strip along one side of the tear strip to define a longitudinal edge region which is bonded to the underlying portion of the inner laminate structure in a peelable manner, and a longitudinal edge of the inner tear strip portion projects beyond a corresponding longitudinal edge of the outer tear strip along the other side of the tear strip to define a longitudinal edge region which is bonded to the overlying portion of the outer laminate structure in a peelable manner.

The outer tear strip portion may have a maximum width of no more than 10 mm, or no more than 8 mm, or no more than 6 mm, or no more than 4 mm, or no more than 2 mm, or no more 1 mm.

The longitudinal edges of the tear strip may be non-linear.

The packet may form an elongate tube surrounding the one or more products having a longitudinal axis, the tubular packet being closed at either end. In which case, the tear strip may extend generally in a lateral direction about the tubular packet at a position between the ends. The tear strip may encircle the tubular packet completely or partially. The tear strip may be positioned proximal to one end of the tubular packet. Alternatively, the tear strip may extend generally in a longitudinal direction of the packet. The tear strip can be aligned transversely or longitudinally or it can be angled relative to the longitudinal axis of the packet. The tear strip can be any desired shaped and may be straight, angled or curved. The tear strip can begin and end at any desired positions in the packet.

The packet may be a flow-wrapped packet. The packet may have a longitudinal fin seal or a longitudinal lap seal. The ends of the tubular packet may be crimped to form end fin seals or they may be folded to produce overlaying flaps which form end closures.

The at least one product may be a substantially rigid product which is not able to pass through an opening formed in the packet by removal of the tear strip as such. In this case, the tear strip may be positioned so that once opened, an end region of the packet can be folded over an end of the product to allow access to the product. The product may be generally block shaped.

The at least one product may at least one confectionery product. The at least one confectionery product may be a chocolate or other snack bar.

The at least one product may comprise a plurality of confectionery products aligned in a stack. The confectionery products may be gum pellets, mints, gums, hard boiled sweets, candies, chocolates, toffee and the like.

In accordance with a second embodiment of the invention, there is provided a section of laminated material for forming a package, the material comprising an outer laminate structure and an inner laminate structure, the outer and inner laminate structures being bonded together in face to face relation, the section of laminated packaging material having opening arrangement comprising a tear strip defined in the material, the tear strip having an outer tear strip portion defined in the outer laminate structure between two spaced outer lines of weakness in the outer laminate structure and at least one inner line of weakness in the inner laminate structure offset from but following the same general path as the spaced outer lines of weakness, at least part of the tear strip defined in one of the outer and inner laminate structures being bonded to an overlapping region of the other of the outer and inner laminate structures in a peelable manner.

In one arrangement, the opening arrangement comprises only a single inner line of weakness in the inner laminate structure located between the spaced outer lines of weakness, the outer tear strip portion being bonded to the underlying region of the inner laminate structure in a peelable manner.

In an alternative arrangement, the tear strip comprises an inner tear strip portion defined in the inner laminate structure between two spaced inner lines of weakness in the inner structure. Each of the inner lines of weakness may substantially following the path of a corresponding one of the outer lines a weakness and at least one of the inner lines of weakness may be offset relative to its corresponding outer line of weakness. The outer tear strip portion may be bonded to the inner tear strip portion, in which case the bond strength between the inner and outer tear strip portions is stronger than the peelable bond between said at least part of the tear strip defined in one of the outer and inner laminate structures and the overlapping region of the other of the outer and inner laminate structures. In one embodiment, a peelable adhesive is used to bond said at least part of the tear strip defined in one of the outer and inner laminate structures and the overlapping region of the other of the outer and inner laminate structures in a peelable manner and a permanent adhesive used to bond the inner and outer laminate structures together where the structures are not intended to be separated. In another embodiment the inner and outer laminate structures are bonded with a single adhesive, the adhesive being patterned to provide the different required bond strengths. The adhesive may be a permanent adhesive, a peelable/resalable adhesive or cold seal. The outer tear strip portion may not be bonded to the inner tear strip portion, in which case the outer lines of weakness only extend partway through the outer laminate structure.

At least one of the outer and inner tear strip portions may have a longitudinal edge region which projects in a lateral direction of the tear strip beyond a corresponding longitudinal edge of the other of the outer and inner tear strip portions to define a longitudinal edge region which overlaps a portion of one of the outer and inner laminate structures, the longitudinal edge region being bonded to the overlapping portion of said one of the outer and inner laminate structures in a peelable manner.

The inner tear strip portion may be narrower than the outer tear strip portion, the outer tear strip portion having at least one longitudinal edge region which projects beyond a corresponding longitudinal edge of the inner tear strip portion, and the at least one longitudinal edge region may be bonded to an underlying portion of the inner laminate structure in a peelable manner. Both longitudinal edges of the outer tear strip portion may project beyond the corresponding longitudinal edges of the inner tear strip portion to define longitudinal edge regions on either side of the tear strip, in which case both longitudinal edge regions may be bonded to respective underlying portions of the inner laminate structure in a peelable manner.

The inner tear strip portion may be wider than the outer tear strip portion, the inner tear strip portion having at least one longitudinal edge region which projects beyond a corresponding longitudinal edge of the outer tear strip portion and the at least one longitudinal edge region may be bonded to an overlying portion of the outer laminate structure in a peelable manner. Both longitudinal edges of the inner tear strip portion may project beyond the corresponding longitudinal edges of the outer tear strip portion to define longitudinal edge regions on either side of the tear strip, in which case both longitudinal edge regions may be bonded to respective overlying portions of the outer laminate structure in a peelable manner.

The inner tear strip portion may be partially offset to one side of the outer tear strip portion so that a longitudinal edge of the outer tear strip portion projects beyond a corresponding longitudinal edge of the inner tear strip along one side of the tear strip to define a first longitudinal edge region and a longitudinal edge of the inner tear strip portion projects beyond a corresponding longitudinal edge of the outer tear strip along the other side of the tear strip to define a second longitudinal edge region, in which case the first longitudinal edge region in the outer laminate structure may be bonded to the underlying portion of the inner laminate structure in a peelable manner whilst the second longitudinal edge region in the inner laminate structure may be bonded to the overlying portion of the outer laminate structure in a peelable manner.

The outer tear strip portion may have a maximum width of no more than 10 mm, or no more than 8 mm, or no more than 6 mm, or no more than 4 mm, or no more than 2 mm, or no more 1 mm.

The material may be a laminated board, such as paperboard, cartonboard, cardboard or the like.

The section of material may be a flexible laminated wrapper which may form part of a continuous length of flexible laminated packaging material having a plurality of opening arrangements defined along its length. The continuous length may be formed into a roll.

The tear strip may extend in any desired direction in the material and may be any desired shape. In one embodiment, the tear strip extends in a generally transverse direction of the section of material across the whole or part of its width.

In accordance with a third aspect of the invention, there is provided a method of manufacturing a package assembly comprising one or more products and a packet enclosing the one or more products, the method comprising:

a. forming a flexible laminated material comprising an outer laminate structure and an inner laminate structure aligned in face to face relation;
b. producing two spaced outer lines of weakness in the outer laminate structure to define an outer tear strip portion;
c. producing at least one inner line of weakness in the inner laminate structure offset from but following the same general path as the spaced outer lines of weakness; and
d. bonding at least part of the tear strip defined in one of the outer and inner laminate structures to an overlapping region of the other of the outer and inner laminate structures in a peelable manner.

The method may also comprise forming the packaging material into a packet enclosing the one or more products.

The material may be a laminated board, such as paperboard, cartonboard, cardboard or the like.

The material may be a flexible laminated wrapper and the method may comprise forming a plurality of wrappers in a continuous length. The method may comprise forming the wrapper into a packet enclosing the one or more products using flow-wrap techniques.

The lines of weakness may be produced in the respective outer and inner laminate structures either before or after the structures are bonded together or a combination of the two.

The method may comprise applying a permanent laminating adhesive and a peelable adhesive to a surface of at least one of the outer and inner laminate structures at appropriate positions for registration with the lines of weakness.

The method may comprise applying a single adhesive to a surface of at least one of the outer and inner laminate structures and patterning the adhesive in registration with the lines of weakness to form the required range of bond strengths.

In one arrangement, the method comprises producing only a single inner line of weakness in the inner laminate structure located between the spaced outer lines of weakness and bonding the outer tear strip portion to the underlying region of the inner laminate structure in a peelable manner.

In an alternative arrangement, the method comprises producing two spaced inner lines of weakness in the inner structure to define an inner tear strip portion. The inner lines of weakness may each substantially follow the path of a corresponding one of the outer lines a weakness, at least one of the inner lines of weakness may be produced in a position that is offset relative to its corresponding outer line of weakness.

The method may comprise positioning the lines of weakness such that at least one of the outer and inner tear strip portions has a longitudinal edge region which projects in a lateral direction of the tear strip beyond a corresponding longitudinal edge of the other of the outer and inner tear strip portions to define a longitudinal edge region which overlaps a portion of one of the outer and inner laminate structures, the longitudinal edge region being bonded to the overlapping portion of said one of the outer and inner laminate structures in a peelable manner.

The method may comprise bonding the inner and outer laminate structures together using one or more adhesives and patterning the adhesive such that the outer tear strip portion is not bonded to the inner tear strip portion, and forming the lines of weakness in the outer laminate structure such that only extend part way through the outer laminate structure.

The method may comprise bonding the inner and outer laminate structures together using one or more adhesives and patterning the adhesive(s) so that the bond strength between the outer and inner tear strip portions is stronger than the bond strength between said longitudinal edge region of one of the inner and outer tear strip portions and the overlapping portion of one of the outer and inner laminate structures. The method may comprise bonding the inner and outer laminate structures together over the majority of their opposed surface areas with a permanent laminating adhesive and bonding said longitudinal edge region of one of the inner and outer tear strip portions and the overlapping portion of one of the outer and inner laminate structures with a peelable adhesive. In an alternative arrangement, the method may comprise bonding the inner and outer laminate structures together using only a single adhesive, the method comprising patterning the adhesive so that the bond strength formed between the inner and outer laminate structures is lower where a peelable bond is required than in regions where the inner and outer laminate structures are not intended to be separated.

The method may comprise forming the lines of weakness such that the spacing between the inner lines of weakness is less than the spacing between the outer lines of weakness such that the inner tear strip portion is narrower than the outer tear strip portion, the outer tear strip portion having at least one longitudinal edge region which projects beyond a corresponding longitudinal edge of the inner tear strip portion and the method may comprise bonding the at least one longitudinal edge region of the outer tear strip portion to an underlying portion of the inner laminate structure in a peelable manner. The method may comprise forming the lines of weakness such that both longitudinal edges of the outer tear strip portion may project beyond the corresponding longitudinal edges of the inner tear strip portion to define longitudinal edge regions on either side of the tear strip, in which case, the method may comprise bonding both longitudinal edge regions of the outer tear strip portion to respective underlying portions of the inner laminate structure in a peelable manner.

The method may comprise forming the lines of weakness such that the spacing between the inner lines of weakness may be greater than the spacing between the outer lines of weakness such that the inner tear strip portion is wider than the outer tear strip portion, the inner tear strip portion having at least one longitudinal edge region which projects beyond a corresponding longitudinal edge of the outer tear strip portion and the method may comprise bonding the at least one longitudinal edge region of the inner laminate structure to an overlying portion of the outer laminate structure in a peelable manner. The method may comprise forming the lines of weakness such that both of the longitudinal edges of the inner tear strip portion project beyond the corresponding longitudinal edges of the outer tear strip portion to define longitudinal edge regions on either side of the tear strip, in which case the method may comprise bonding both longitudinal edge regions of the inner laminate structure to respective overlying portions of the outer laminate structure in a peelable manner.

The method may comprise forming the lines of weakness such that the inner tear strip portion is partially offset to one side of the outer tear strip portion so that a longitudinal edge of the outer tear strip portion projects beyond a corresponding longitudinal edge of the inner tear strip along one side of the tear strip to define a first longitudinal edge region and a longitudinal edge of the inner tear strip portion projects beyond a corresponding longitudinal edge of the outer tear strip along the other side of the tear strip to define a second longitudinal edge region, and bonding the first longitudinal edge region to the underlying portion of the inner laminate structure in a peelable manner and bonding the second longitudinal edge region to the overlying portion of the outer laminate structure in a peelable manner.

The method may comprise forming the lines of weakness by means of laser etching or by scoring. The method may comprise forming the lines of weakness using a pair of contra-rotating die cylinders positioned on opposite sides of the laminated material, one of the die cylinders being positioned for contact with the outer laminate structure and having blades for forming the outer lines of weakness, the other die cylinder being arranged for contact with the inner laminate structure and having one or more blades for forming the inner line(s) of weakness.

The step of forming the packaging material into a packet enclosing the one or more products may comprise flow wrapping a product or a stack of products in which the packet is formed from a continuous roll of wrappers by folding an end region of the roll about a product or a stack of products, bringing longitudinal side edges of the material into face to face contact and bonding the longitudinal side edges together to form a longitudinal fin seal, crimping the material at either end of the product or stack to form end seals and cutting the material to separate the packet from the remainder of the film. The method of forming the packet may be repeated to package a plurality of products or stacks of products from the roll of material in a substantially continuous process.

DETAILED DESCRIPTION OF THE INVENTION

Several embodiments of the invention will now be described, by way of example only, with reference to the accompanying drawings, in which.

Figure 16:
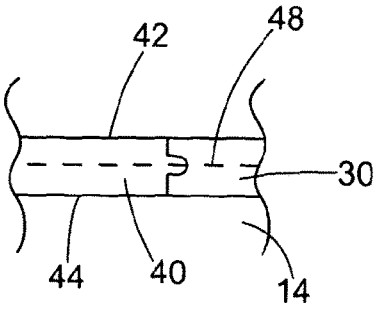
Figure 17:
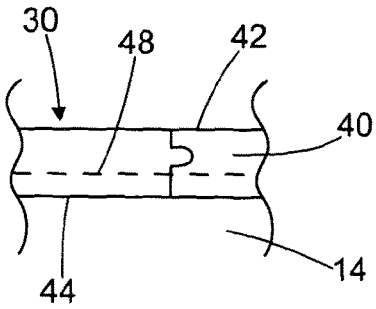
Figure 18:
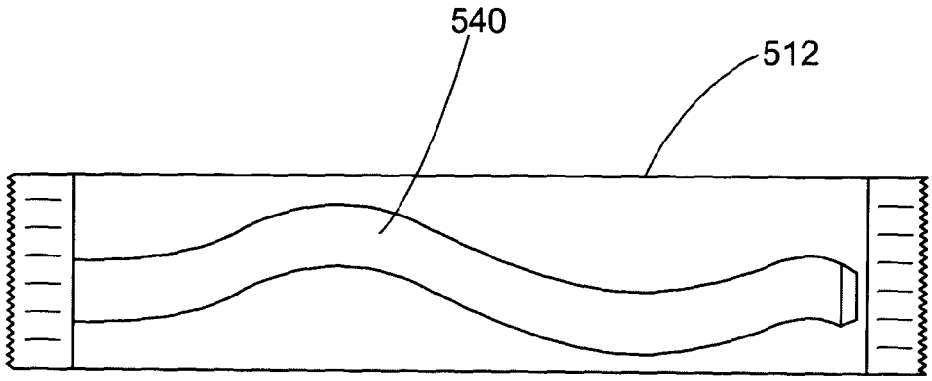
Figure 19:
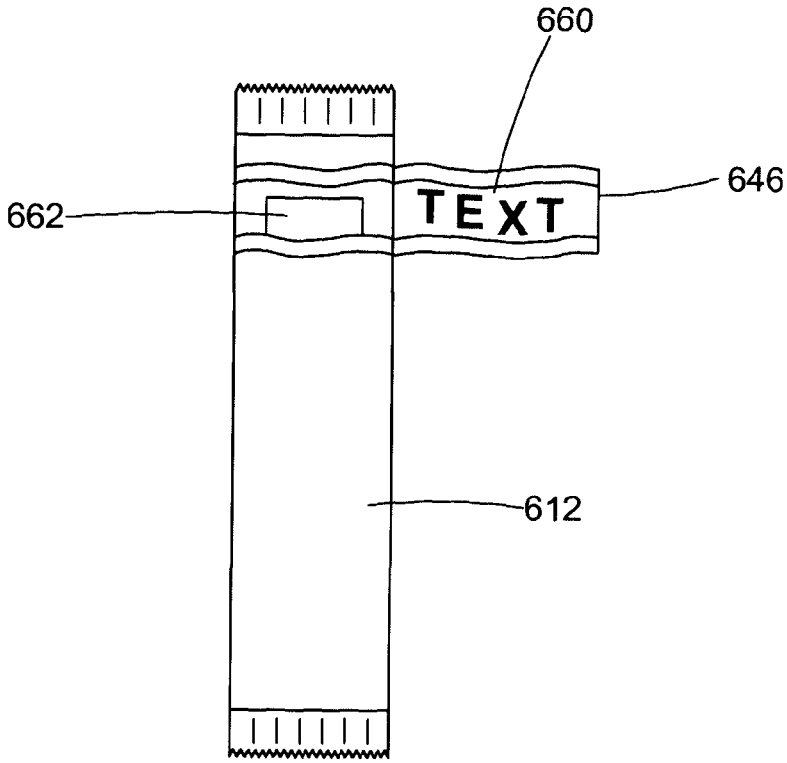

FIGS. 12 to 17 are partial views of a wrapper forming part of a package assembly in accordance with the invention illustrating alternative opening arrangements that can be adopted in any of the embodiments described herein; and FIG. 18 is a plan view of a sixth embodiment of a package assembly in accordance with the invention having a longitudinally aligned tear strip with curved edges; and FIG. 19 is a plan view of a seventh embodiment of a package assembly in accordance with the invention in which printing is applied to the inner surface of the tear strip to be revealed when the tear strip is opened.

The same reference numerals but increased by 100 in each case will be used to identify the same or similar features in the various embodiments described below.

FIGS. 1 to 4 illustrate a first embodiment of a packaging assembly 10 in accordance with the invention. The package assembly 10 comprises one or more products, in this case a chocolate bar (not shown), which is encased in a tubular packet 12 formed from a wrapper 14 of flexible material.

Figure 1:
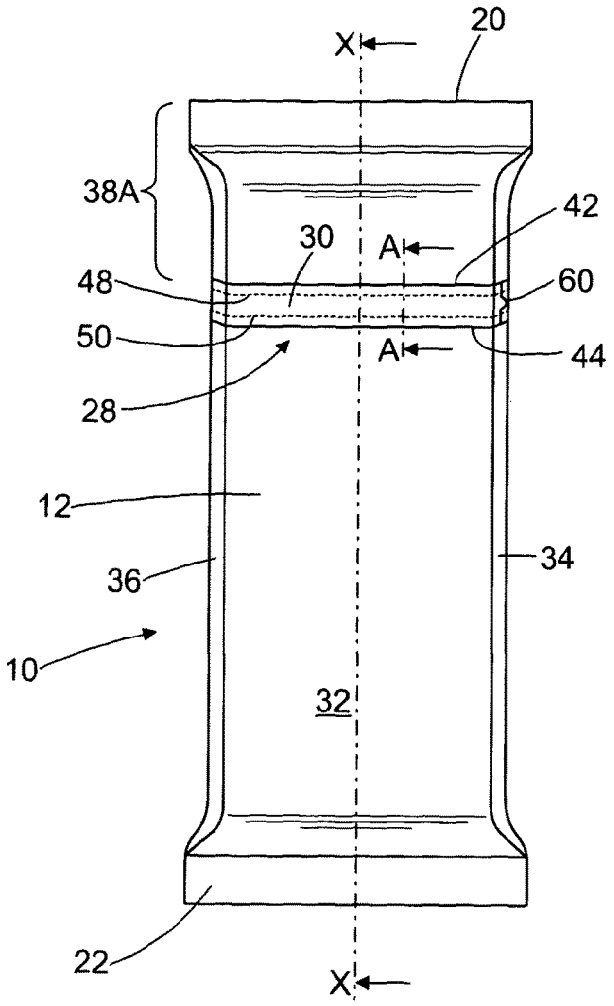
FIG. 1 is a plan view of a first embodiment of a package assembly in accordance with the present invention.
Figure 2:
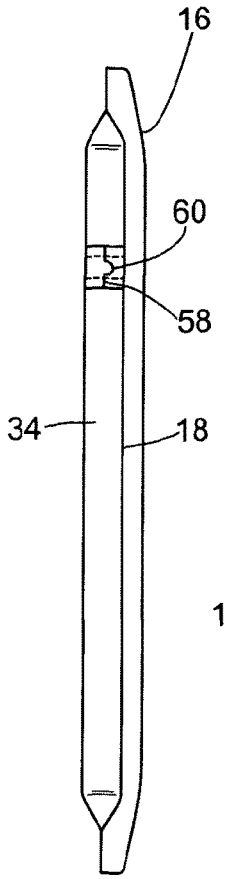
FIG. 2 is a view of the package assembly of FIG. 1 taken from one side.
Figure 3:
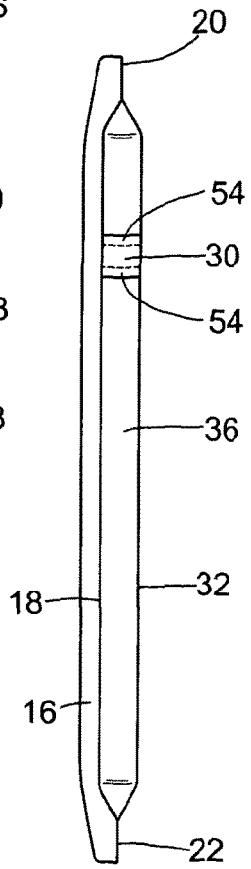
FIG. 3 is a view of the package assembly of FIG. 1 taken from the other side.

The wrapper 14 of flexible material is folded around the product and sealed to fully enclose the product. Longitudinal edge regions of the wrapper 14 are bonded together, inner face to inner face, to form a longitudinal fin seal 16 which extends along a rear face 18 of the packet. Opposing end edge regions of the wrapper that extend beyond the ends of the chocolate bar are bonded together in face to face relation to form transverse seals 20, 22 at either end of the product in a known manner. The longitudinal and transverse seals 16, 20, 22 can be formed using an adhesive to bond the opposing surfaces of the wrapper or by heating the material under pressure so that the opposing surfaces melt and fuse together to form a welded seal. The longitudinal seal 16 is referred to as a "fin seal" because it projects outwardly in the manner of a fin as shown in FIGS. 2 and 3 when first formed. Usually, however, the fin seal 16 will be folded over to one side or the other when the package is completed.

The packet 12 is a flow-wrap packet and is formed in a form-fill-seal (FFS) packaging machine (not shown). The wrapper 14 is provided as part of a continuous length of wrappers that is roll fed into the machine and folded about each product in turn. The inner surfaces of opposing longitudinal edge regions of the wrapper are brought into contact and bonded together to form the longitudinal fin seal 16. Opposing regions of the material at either end of the product are also brought into contact and bonded to form the transverse end seals 20, 22 and the material is cut to separate each packet 12 from the remainder of the material. The packaging material may be referred to as a film, though it should be understood that this term is not intended to imply that the material is necessarily transparent or translucent. The material may be printed on in a known manner.

The wrapper 14 comprises a lamination of two or more layers of flexible materials that are bonded together face to face. Where the product is a food product, at least one of the layers may be substantially moisture and gas impervious and the packet can be hermetically sealed. It should be noted though that for some food products a hermetically seal packet is not desirable. Examples of typical materials that can be used include: paper based materials, one or more polymeric materials including thermoplastic materials such as polyethylene terephthalate (PET), and metallic foils.

For the purposes of the following description and the accompanying claims, the laminated wrapper 14 can be considered has having an inner laminate structure 24, for positioning proximal to the product, and an outer laminate structure 26, for positioning distal from the product. The inner and outer laminate structures 24, 26 are bonded together face to face and each comprises one or more layers of material. For example, the wrapper 14 could be a lamination of only two layers of material which might be an inner layer of paper and an outer layer of a metallic foil, such as an aluminium foil. In this case, the paper layer constitutes the inner laminate structure and the metal foil the outer laminate structure. However, in more complex embodiments one or both of the inner and outer laminate structures may have more than one layer of material. An example of this might be a wrapper having an inner layer of paper, a layer of a metallic foil on the outside of the paper and a layer of a polymeric material on the outside of the foil. In this case, the paper layer may constitute the inner laminate structure whilst the layer of foil and the polymeric layer together constitute the outer laminate structure. The polymeric material may be a thermoplastic material such as polyethylene terephthalate (PET), for example.

The packet 12 includes an opening arrangement in a side wall portion of the tubular packet indicated generally at 28. The opening arrangement includes a tear strip 30 which is aligned so as to extend in a lateral direction, perpendicular to a longitudinal axis X-X of the tubular packet 12. The tear strip 30 in the present embodiment does not completely encircle the packet but extends across a front face 32 and down both sides 34, 36. The tear strip 30 is located closer to one end 38 of the packet 12 and is configured so that after opening, the end region 38A can be folded over to allow access to the product inside the packet.

Figure 4:
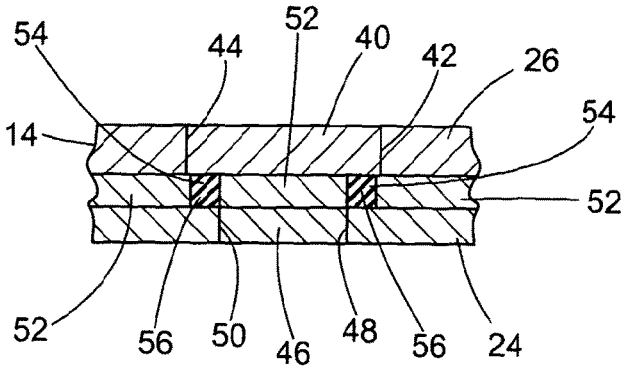
FIG. 4 is a cross sectional view on an enlarged scale through part of an opening arrangement forming part of the package assembly of FIG. 1, taken on line A-A.

As can be seen best in FIG. 4, the tear strip 30 comprises an outer tear strip portion 40 which is defined in the outer laminate structure 26 between two spaced lines of weakness 42, 44. The lines of weakness 42, 44 in the outer laminate structure will be termed "outer" lines of weakness for ease of reference. The tear strip 30 also includes an inner tear strip portion 46 which is defined in the inner laminate structure 24 between two spaced lines of weakness 48, 50 formed in the inner laminate structure 24. The lines of weakness 48, 50 in the inner laminate structure 24 will be termed "inner" lines of weakness for ease of reference. The inner lines of weakness 48, 50 generally follow the same paths as the corresponding outer lines of weakness but are offset inwardly from their corresponding outer lines of weakness 42, 44 so that the inner tear strip portion 46 is narrower than the outer tear strip portion 40.

Over the majority of their area, the opposing bonding surfaces of the inner and outer laminate structures 24, 26 are bonded together with a permanent laminating adhesive 52 which resists separation of the two structures. As is illustrated in FIG. 4, the outer tear strip portion 40 in the outer laminate structure is also bonded to the inner tear strip portion 46 in the inner laminate structure using a permanent laminating adhesive 52. However, longitudinal side edge regions 54 of the outer tear strip portion 40 which lie outside of the inner lines of weakness 48, 50 are bonded to the underlying portions of the inner laminate structure 24 using a peelable adhesive 56. In some embodiments, the peelable adhesive 56 is a re-sealable adhesive to enable the packet to be reclosed but this is not essential to the broadest aspect of the present invention. A further line of weakness 58 is formed in the outer laminate structure 26 and extends in a generally longitudinal direction of the packet between the outer lines of weakness 42, 44 to define an end of the outer tear strip portion 40. The further line of weakness 58 is shaped to define a tab 60. At least an outer part of the tab 60 is not bonded to the inner laminate structure 24 so that the tab can be grasped by a consumer to initiate opening of the packet 12. A corresponding further line of weakness may be provided in the inner laminate structure to define an end of the inner tear strip portion. The corresponding further line of weakness in the inner layer may be offset form the line of weakness in the outer layer. The other end of the tear strip remains attached to the remainder of the wrapper in this embodiment.

To open the packet 12, the consumer grasps the tab 60 and pulls the outer tear strip portion 40 away from and around the main body of the packet. As the outer tear strip portion 49 is pulled, it separates from the remainder of the outer laminate structure 26 along the outer lines of weakness 42, 44. Because the inner tear strip portion 46 is bonded to the outer tear strip portion 40 with a permanent adhesive, the inner tear strip portion is pulled away with the outer tear strip portion 40 and separates from the remainder of the inner laminate structure 24 along the inner lines of weakness 48, 50. The longitudinal side edge regions 54 of the outer tear strip portion 40 separate from the underlying regions of the inner laminate structure 24 because they are bonded using a peelable adhesive. Once the tear strip 30 has been fully opened, the end region of the packet can be folded back to reveal an end of the chocolate bar inside.

The opening arrangement 28 enables the packet 12 to be opened by the user easily without requiring undue effort and with minimal risk of the packet tearing other than along the lines of weakness. The provision of lines of weakness 42, 44, 48, 50 in both the inner and outer laminate structures means that both can be easily torn in a controlled manner. However, because the inner and outer lines of weakness are offset, the integrity of the packet is maintained prior to opening.

It will be noted that the aperture produced when the tear strip 30 is opened is not in large enough for the product to be removed through the aperture itself. Accordingly, the tear strip 30 is positioned and configured such that part of the packet, usually an end region 38A, can be fully or partially removed when the tear strip is opened to gain access to the product. In the present embodiment, the tear strip does not extend fully around the packet so that the end region 38A remains attached to the remainder of the packet and is folded over the end of the product to allow the product, or part of the product, to be removed from the packet. This is advantageous as the end region 38A remains attached to the remainder of the packet and so there is less risk of the end region being discarded to cause a litter problem. In addition, if only part of the product is consumed, the end region 38 can be repositioned to help contain and protect the remaining product. Where the peelable adhesive 56 used to bond the longitudinal side edges 54 of the outer tear strip portion 40 is a resealable adhesive, it would be possible to reposition the tear strip 30 to partially re-close the packet and hold the end region 38A in place. Alternatively, the tear strip could be positioned so that it extends across the gap between the end region 38A and the remainder of the packet and stuck to both portions to hold the end region 38A in position. In this arrangement, the tear strip functions as a re-closure tab. Whilst a re-sealable adhesive will not form as strong a bond on re-closing as it does initially, sufficient bonding strength should remain to enable the packet to be opened and reclosed a number of times. For use as a re-closure tab, the tear strip may be defined so that it is completely removed from the wrapper when opened for ease of positioning. In other embodiments, the tear strip 30 can be arranged to completely encircle the packet so that the end region 38A is completely removed when the tear strip is opened.

The lines of weakness 42, 44, 48, 50 may be continuous or they may be discontinuous. The lines of weakness may extend fully through their respective laminate structure 24, 26 or they may only extend partway through. The lines of weakness could be in the form of score lines or perforations, for example. The lines of weakness can be formed using any suitable methods such as by laser etching or scoring. In one embodiment, the lines of weakness are produced using a pair of contra-rotating die cylinders positioned on opposite sides of the laminated material, one of the die cylinders being positioned for contact with the outer laminate structure and having blades for forming the outer lines of weakness, the other die cylinder being arranged for contact with the inner laminate structure and having blades for forming the inner lines of weakness.

Figure 5:
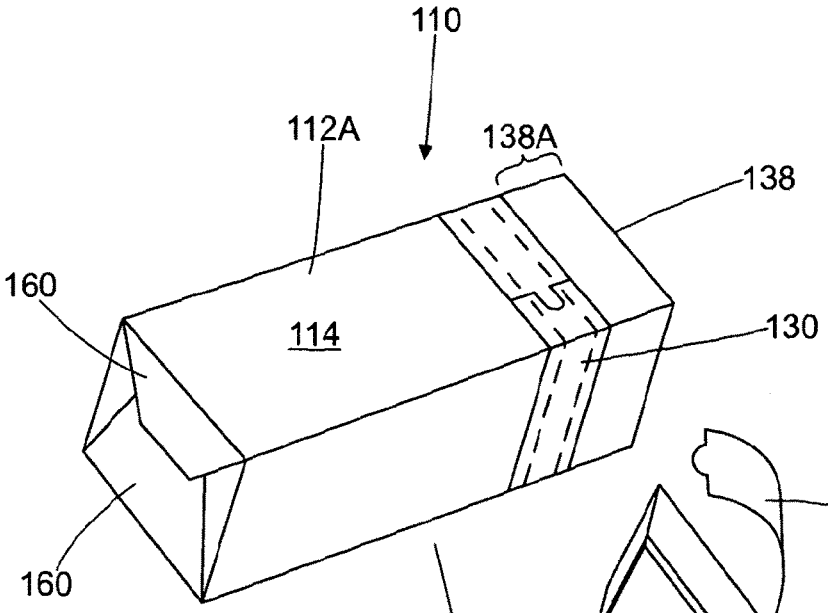
FIG. 5 is a perspective view of a second embodiment of a package assembly in accordance with the present invention, showing the package assembly in a closed condition.
Figure 6:
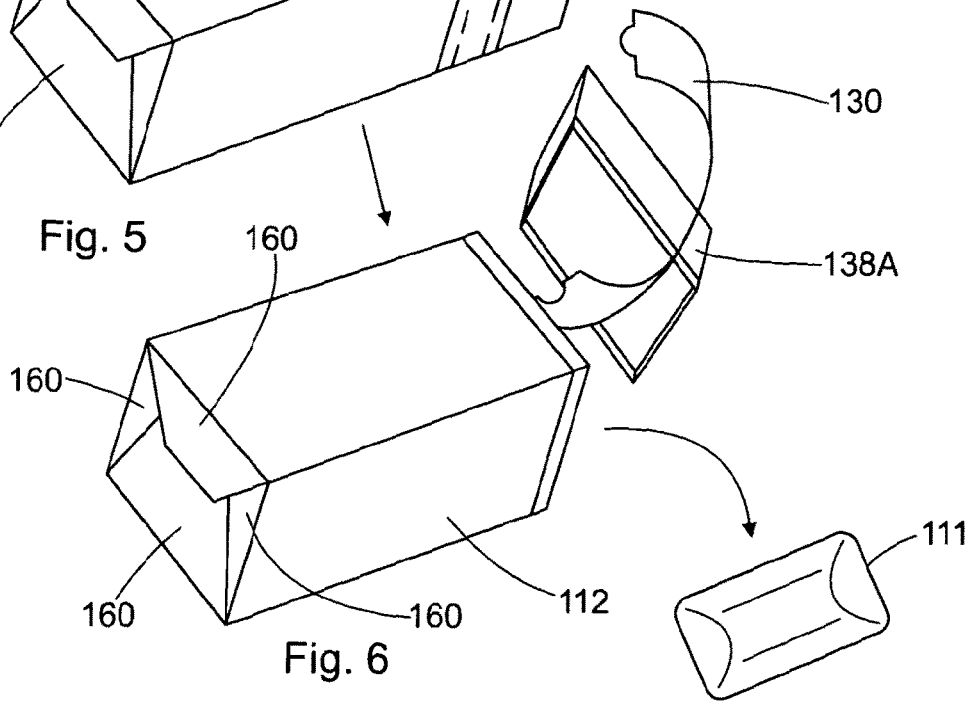
FIG. 6 is a view similar to that of FIG. 5 but showing the package assembly in an open condition.

FIGS. 5 and 6 illustrate a second embodiment of a package assembly 110 in accordance with the invention. The package assembly 110 of the second embodiment comprises a tubular packet 112 formed from a wrapper 114 which encases a plurality of products 111 which are arranged side-by-side in a stack. The products 111 in this case are gum pellets having a rectangular outer peripheral shape. Accordingly, the side wall region 112A of the tubular packet 112 has a corresponding rectangular profile in lateral cross section. The packet 112 in this embodiment is not flow wrapped but rather the wrapper 114 is folded circumferentially about the stack so that one longitudinal edge of the wrapper overlaps the other longitudinal edge and is held in place by means of adhesive or otherwise bonded to form a longitudinal seal. In this case the longitudinal seal is flat rather than in the form of a fin seal. The wrapper is longer than the stack and the protruding ends of the wrapper are folded to form tabs 160 in an overlapping arrangement to close the ends of the packet. The end closure tabs 160 are adhered to one another so that the wrapper forms an at least partially sealed packet for the products 111.

The wrapper 114 is a laminate having an inner and an outer laminate structure and the wrapper includes an opening arrangement comprising a tear strip 130 which is constructed in substantially the same manner as the tear strip 30 described above in relation to the first embodiment 10, to which the reader should refer for details. In this case however, the tear strip 130 extends across the full width of the wrapper so that it completely encircles a side wall region of the completed packet close to one end 138. As a result, an end region 138A of the packet is completely removed when the tear strip 130 is opened, as illustrated in FIG. 6.

Figure 7:
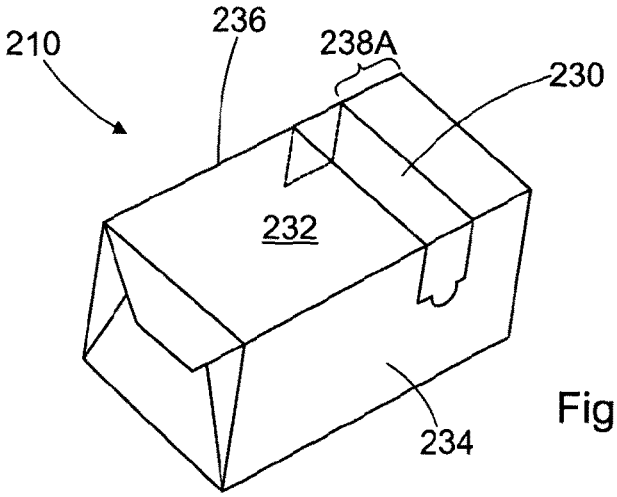
FIG. 7 is a perspective view of a third embodiment of a package assembly in accordance with the present invention.

FIG. 7 illustrates a third embodiment of a package assembly 210 in accordance with the invention. The package assembly 210 of the third embodiment is substantially the same as that of the second embodiment except that in this case the tear strip 230 does not extend completely around the packet but only across a front face 232 and partially down the two adjacent side faces 234, 236. The tear strip 230 in this embodiment is configured so that the end region 238A of the packet is folded over the end of enclosed stack of products after the tear strip has been opened to gain access to the products. In this embodiment, the end region 238A can be repositioned after one or more of the products have been removed to at least partially reclose the packet. Where a re-sealable adhesive is used to bond the side edge regions of the outer tear strip portion, then the tear strip can be reclosed or used as a re-closure tab as described above in relation to the first embodiment 10.

Figure 8:
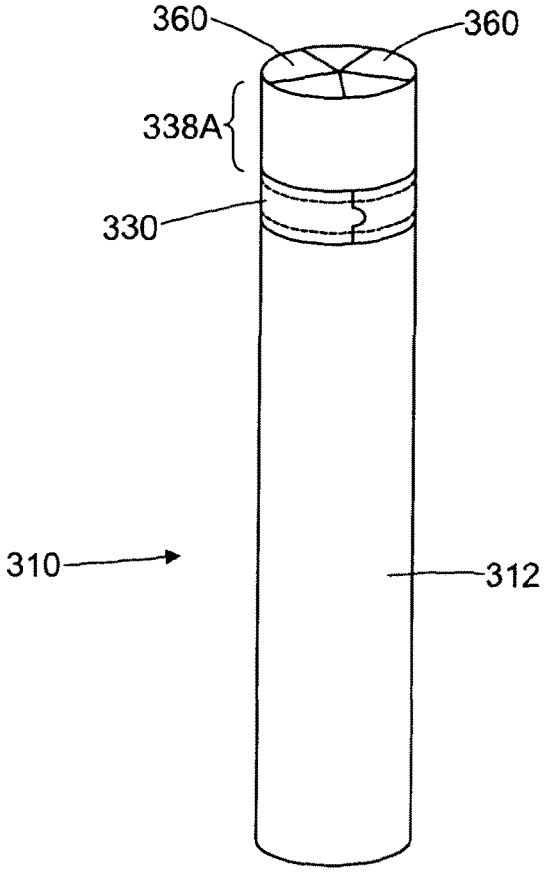
FIG. 8 is a perspective view of a fourth embodiment of a package assembly in accordance with the present invention.
Figure 9:
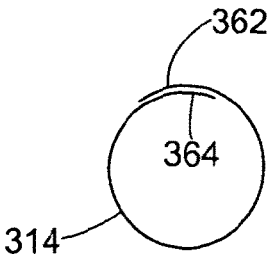
FIG. 9 is a cross sectional view through the package assembly of FIG. 8 taken on line B-B.

FIGS. 8 and 9 illustrate a fourth embodiment of a package assembly 310 in accordance with the invention. In this embodiment, the package assembly also comprises a stack of products arranged side-by-side and which are enclosed by a tubular packet 312 in a manner similar to the second and third embodiments. However, in this case the products have a circular outer profile so that the side wall region of the packet 312 has corresponding circular shape in lateral cross section. The products in this case could be mints, wine gums, hard boiled sweets or any other product with a circular outer profile. As with the previous two embodiments, the wrapper 314 is folded circumferentially about the stack so that one longitudinal edge 362 of the wrapper overlaps the other longitudinal edge 364 and is held in place by means of adhesive or otherwise bonded to form a longitudinal seal as shown in FIG. 9. The longitudinal ends of the wrapper are folded to form tabs 360 in an overlapping arrangement to close the ends of the packet.

The wrapper 314 is a laminate having an inner and an outer laminate structure and is provided with tear strip 330 which extends completely around the packet close to one end 338 so that on opening, the end region 338A is completely removed. The tear strip 330 is constructed and used in the same manner as the tear strip 30 described above in relation to the first embodiment, to which the reader should refer for details.

It should be appreciated that fourth embodiment could be modified so that the tear strip 330 only extends part way around the side wall region of the packet so that the end region 338A remains attached to the remainder of the packet. In this arrangement, the end region 338A is folded over the end of the stack of products when the packet is opened and can be repositioned to at least partially reclose the packet. Where a re-sealable adhesive is used to bond the side edge regions of the outer tear strip portion, the tear strip can be reclosed or used as a re-closure tab as described above in relation to the first embodiment 10.

Figure 10:
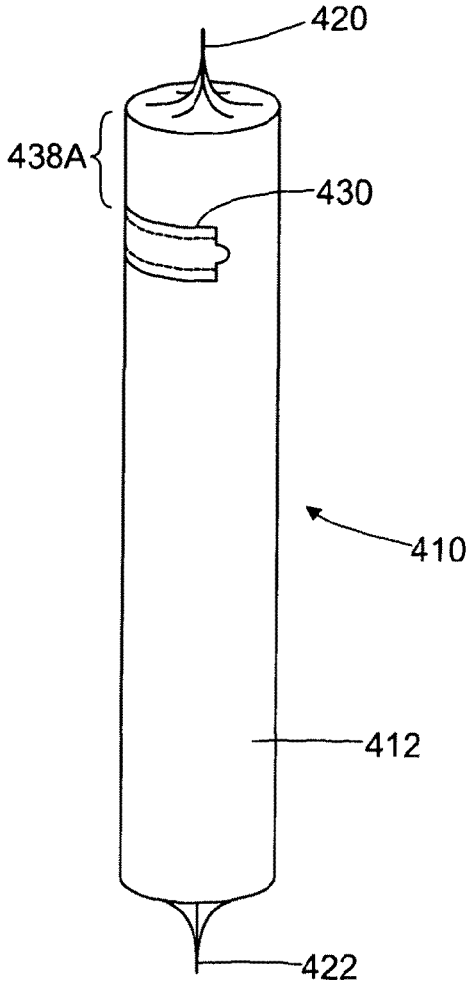
FIG. 10 is a perspective view of a fifth embodiment of a package assembly in accordance with the present invention.
Figure 11:
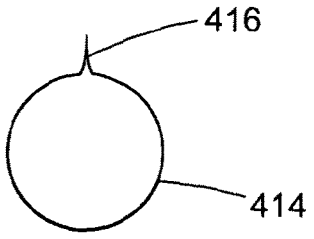
FIG. 11 is a cross sectional view through the package assembly of FIG. 10 taken on line C-C.

FIGS. 10 and 11 show a fifth embodiment of a package assembly 410 in accordance with the invention. As with the previous embodiment, the package assembly of the fifth embodiment comprises a stack of circular products arranged side-by-side and which are enclosed by a tubular packet 412. However, in this case the packet 412 is a flow-wrap packet having a fin seal 416 and the tear strip 430 only extends around a part of the side wall of the packet 412.

The fifth embodiment illustrates how a flow-wrap packet can be adapted to package a stack of products with the wrapper being folded around the product and longitudinal edge regions of the wrapper bonded together, inner face to inner face, to form a longitudinal sealed fin seal 416. This can be seen best in FIG. 11. The ends of the wrapper that extend beyond the ends of the stack are bonded together to form end seals 420, 422 which may extend transversely.

The wrapper 414 is a laminate having an inner and an outer laminate structure and is provided with tear strip 430 which extends only part way around a side wall region of the packet. Thus when the tear strip 430 is opened, the end region 438A of the packet is folded over the end of the stack to allow access to the products. In this embodiment, the end region 438A can be repositioned after one or more of the products have been removed to at least partially reclose the packet. Where a re-sealable adhesive is used to bond the side edge regions of the outer tear strip portion, then the tear strip can be reclosed or used as a re-closure tab as described above in relation to the first embodiment 10. The tear strip 430 is constructed and functions in the same manner as the tear strip 30 described above in relation to the first embodiment 10, to which the reader should refer for details.

It should be appreciated that the tear strip 430 in the fifth embodiment could be arranged to completely encircle the packet 412 so that the end region 438A can be completely removed.

FIGS. 12 to 17 illustrate modifications to the opening arrangement 28 of the first embodiment 10 but which can be adopted in any of the other embodiments disclosed herein.

Figure 12:
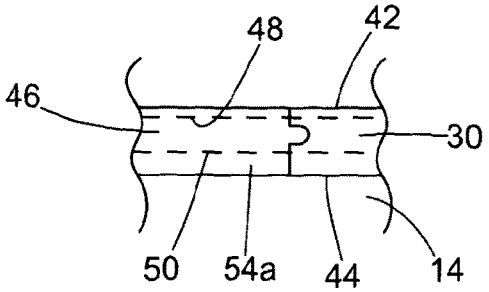
Figure 13:
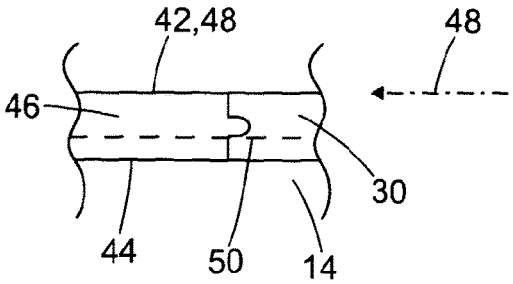

In the embodiment as shown in FIGS. 1 to 4, the inner lines of weakness 48, 50 are spaced inwardly from the outer lines of weakness 42, 44 by an equal amount so that the inner tear strip position 46 is aligned substantially centrally of the outer tear strip portion 40. However, as illustrated in FIG. 12, in some applications, it may be desirable to offset the inner tear strip portion 46 towards one of the outer lines of weakness 42. This has the effect of increasing the surface area of one of the longitudinal edge regions 54*a* of the outer tear strip portion 40 which overlies the inner laminate structure outside of the inner lines of weakness. This can be an advantage where it is intended that the tear strip 30 be reclosable as it provides an increased area on one side of the tear strip on which the peelable an re-sealable adhesive is applied. This may be easier for a user to reclose than two smaller areas on either side of the tear strip. The inner tear strip portion 46 could be offset in either direction and by varying amounts. In an extreme case, the inner tear strip portion can be offset so that one of the inner lines of weakness 48 is positioned inline with one of the outer lines of weakness 42 as illustrated by the arrow in FIG. 13. In this case, one or both of the overlying lines of weakness 42, 48 will usually be either non-continuous or only extend though part of the thickness of its respective laminate structure to maintain the integrity of the packet prior to opening. Alternatively, the adhesive layer between the inner and outer laminate structures can be relied upon to seal the packet.

Figure 14:
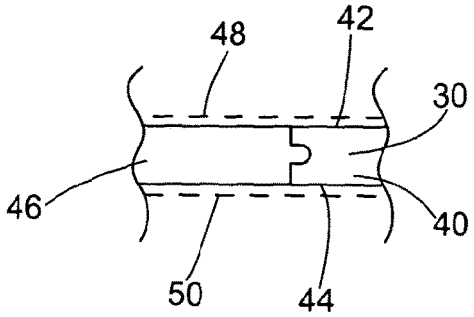

In the arrangement illustrated in FIG. 14, the inner lines of weakness 48 50 are spaced apart by a greater distance than the outer lines of weakness 42, 44 so that the inner tear strip portion 46 is wider than the outer tear strip portion 40. In this case, longitudinal edge regions are defined along either side of the inner tear strip portion 46 between the each inner line of weakness 48, 50 and its corresponding outer line of weakness 42, 44. The longitudinal edge regions of the inner tear strip portion are bonded to the overlying portions of the outer laminate structure with a peelable adhesive whilst the outer tear strip is permanently bonded to the inner tear strip. With this embodiment, as the consumer pulls the outer tear strip portion 30, the inner tear strip portion 40 is pulled out through the opening formed in the outer laminate structure as the longitudinal edge regions peel away from the outer laminate structure. This arrangement generally requires that the laminate material is sufficiently flexible that the longitudinal edge regions of the inner tear strip portion can bend as they are pulled out through the opening in the outer laminate structure. The overlapping longitudinal edge regions of the inner tear strip will usually be relatively thin, being in the region of a few mm, but can be selected as desired dependant on the nature of the material. As with the embodiments described above with respect to FIGS. 12 and 13, the relative positions of the inner and outer tear strip portions can be varied laterally.

Figure 15:
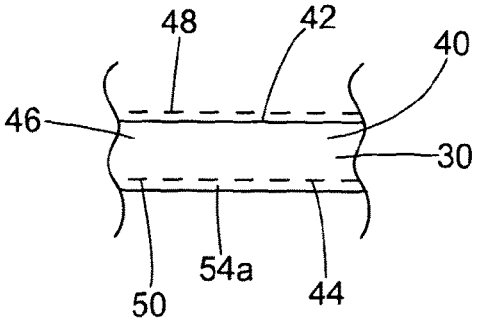

FIG. 15 illustrates an embodiment in which the inner tear strip portion is partially offset to one side of the outer tear strip portion. In this embodiment, one longitudinal edge 44 of the outer tear strip portion 40 projects beyond the corresponding longitudinal edge 50 of the inner tear strip portion 46 to define a first longitudinal edge region 54*a* which is bonded to the underlying portion of the inner laminate structure with a peelable adhesive. On the other side of the tear strip, the longitudinal edge 48 of the inner tear strip portion 46 projects beyond the corresponding longitudinal edge 42 of the outer tear strip portion 40 to define a second longitudinal edge region on the inner tear strip portion which is bonded to the overlying portion of the outer laminate structure by means of a peelable and adhesive. As in all the embodiments, the peelable adhesive may be re-sealable.

FIGS. 16 and 17 illustrate an alternative arrangement in which there is no inner tear strip portion 46 as such. In these embodiments, only one inner line of weakness 48 is provided in the inner laminate. The inner line of weakness is positioned between but follows the same general path as the outer lines of weakness. The whole of the outer tear strip portion 40 is bonded to the underlying region of the inner laminate structure using a peelable and possibly re-sealable adhesive. This enables the outer tear strip portion 40 to be peeled away from the inner laminate structure to reveal the inner line of weakness 48. Where the inner line of weakness 48 is continuous and extends through the full thickness of the inner laminate structure, peeling the outer tear strip portion 40 away will effectively open the packet. However, where the inner line of weakness 48 is discontinuous or where it only extends through part of the thickness of the inner laminate structure then it will be necessary to effect tearing of the inner laminate structure after the outer tear strip portion 40 as been peeled away. This could be done for example by bending the end region packet over to one side by breaking off end of the product adjacent to the tear strip 30 resulting in the inner laminate structure being torn along the inner line of weakness 48. This may be a suitable arrangement where the product is a chocolate bar or the like and where a portion at one end can be snapped off. In a further alternative, the end region of the packet might be pulled away from the remainder of the packet in a longitudinal direction. In FIG. 16, the inner line of weakness 48 is positioned roughly centrally between the outer lines of weakness 42, 44 but the inner line of weakness can be offset as shown in FIG. 17.

The embodiments shown in FIGS. 16 and 17 are particularly suitable where the tear strip is intended to be reclosable as it provides the maximum surface area between the outer tear strip portion 40 and the inner laminate structure on which a peelable and re-sealable adhesive can be applied to enable the outer tear strip portion 40 to be restuck after initial opening.

In all the embodiments described above and as shown in the accompanying drawings, the tear strip 30-430 is aligned to extend perpendicularly to the longitudinal axis of the packet but this is not essential and the tear strip could be angled relative to the longitudinal axis. Furthermore, the tear strip need not be straight but could follow a curved or curvilinear path. Indeed, whilst it is expected that the outer lines of weakness will typically be equi-spaced along their length, this is not essential and the spacing between the outer lines of weakness could be varied, provided the minimum spacing allows for positioning of the inner tear strip portion or the single inner line of weakness. In some applications, the tear strip can be arranged to extend longitudinally as illustrated in FIG. 18 which shows a flow wrapped packet 512 having a longitudinally aligned and curved tear strip 540. In this case, the product is a chocolate bar that is relatively long and thin and the tear strip is sufficiently wide that once opened, an end region of the packet can be folded over to expose an end of the bar. More than one tear strip can be provided in each packet.

Where the packet is a flow wrapped packet, the tear strip can be aligned longitudinally with the lines of weakness either side of the fin seal so that the fin seal forms part of the other tear strip portion. In this embodiment, the fin seal can be gripped by the consumer to effect opening without the need for a separate opening tab.

The position of the tear strip can be aligned with printing on the inner laminate structure so that hidden messages or promotional/competition codes are revealed when the tear strip is opened. In one arrangement, printing on the inner surface of the inner laminate structure is aligned so that it falls within the inner tear strip portion. When the tear strip is opened and folded over, the printing can be read. Alternatively, where the outer tear strip portion has one or more longitudinal edge regions that overly portions of the inner laminate structure, printing can be applied to or otherwise made visible on the outer surface of the inner laminate structure where it is covered by a longitudinal edge region of the outer tear strip portion. The printing is revealed when the tear strip is opened. FIG. 19 illustrates a further embodiment in which a packet 612 has a lateral tear strip 649 which curvy longitudinal edges and in which text 660 has been printed on the inner surface of the inner laminate structure within the inner tear strip portion so as to be visible when the tear strip is opened. An end of the product 662, which in this case is also a chocolate bar, is visible in the gap formed by removal of the tear strip.

In the embodiments as described above, a permanent laminating adhesive 52 is used bond the inner and outer laminate structures over the majority of their opposed surface areas, including between the inner and outer tear strip portions, and a peelable adhesive 56 is used to bond the longitudinal edge regions 54 of the tear strip in a peelable manner. Whilst this is an effective arrangement, it requires that the two adhesives be applied to the materials in correct registration with the lines of weakness. In an alternative arrangement which can be used in any of the embodiments disclosed herein, a single adhesive is used to bond the inner and outer laminate structures but the adhesive is patterned so as to provide different bond strengths as required. In this arrangement, the adhesive will be patterned to provide a lower bond strength in regions where the inner and outer laminate structures are intended to be peeled apart, such the longitudinal edge regions 54 of the tear strip, than in regions where the inner and outer laminate structures are not intended to be separated. Whilst this still requires that the adhesive be patterned in registration with the lines of weakness, this is simpler to achieve when applying a single adhesive at a single adhesive application station than where two adhesives are being applied at separate stations.

A previously mentioned, the lines of weakness need not extend fully through the respective inner and outer laminate structures. For example the outer lines of weakness might only extend partway through the outer laminate structure leaving at least a part of one layer of material forming the outer laminate structure intact. In this case, the material which is uncut by the lines of weakness would be expected to tear relatively easily when the tear strip is opened. Similarly, the inner lines of weakness need not extend fully through the inner laminate structure, leaving at least part of one layer of material forming the inner laminate structure intact. This can help to ensure the integrity of the package prior to opening. Where the outer lines of weakness do not extend fully through the outer laminate structure, the outer and inner tear strip portions need not be bonded together but could be left unbounded. This would provide a double tear strip construction with removal of the outer tear strip portion allowing access to the inner tear strip portion. In this case, information could be printed on the outside of the inner tear strip portion or the inside of the outer tear strip portion to be revealed when the outer tear strip portion is opened.

The foregoing embodiments are not intended to limit the scope of protection afforded by the claims, but rather to describe examples as to how the invention may be put into practice. For example, whilst the embodiments described above are adapted for packaging confectionery products, the packaging arrangements described herein can be adapted for packaging other food and indeed non-food products.

Whilst the invention as claimed in the present application is directed at packing formed from a flexible wrapper or film, many of the teachings in the application can be applied packaging made of other suitable laminated materials. For example, the teaching disclosed herein could be applied packaging made from a flexible laminated board such as paperboard, cartonboard, cardboard or the like. Such materials are used to form cartons and blister packs and the like. Patent protection for the tear strip arrangements disclosed herein when applied to packaging formed from flexible laminated board, such as paperboard, cartonboard, cardboard, may be sort by means of one or more divisional or continuation patent applications.

The invention claimed is:

1. A package assembly comprising one or more products and a packet enclosing the one or more products, the packet having opposing end edge regions and being formed from a flexible laminated wrapper having an outer laminate structure and an inner laminate structure defining a thickness direction therethrough, the packet having an opening arrangement comprising a fully or partially removable tear strip formed in the wrapper extending generally in a lateral direction about the package closer to one of said end edge regions, the tear strip having an outer tear strip portion defined in the outer laminate structure between a pair of outer spaced lines of weakness in the outer laminate structure and at least one inner line of weakness in the inner laminate structure which is offset from the outer lines of weakness in a direction other than said thickness direction, at least part of the tear strip defined in one of the outer and inner laminate structures being bonded to an overlapping region of the other of the outer and inner laminate structures in a peelable manner.

2. A package assembly as claimed in claim 1, in which the at least a part of the tear strip is bonded to the overlapping region of the inner laminate structure by means of a peelable adhesive.

3. A package assembly as claimed in claim 2, in which the peelable adhesive is a re-sealable adhesive.

4. A package assembly as claimed in claim 1, in which the opening arrangement comprises only a single inner line of weakness in the inner laminate structure, the inner line of weakness being located between the spaced outer lines of weakness, the outer tear strip portion being bonded to an underlying region of the inner laminate structure in a peelable manner.

5. A package assembly as claimed in claim 1, in which tear strip comprises an inner tear strip portion defined in the inner laminate structure between two spaced inner lines of weakness in the inner structure.

6. A package assembly as claimed in claim 5, in which the outer tear strip portion is bonded to the inner tear strip portion, the bond strength between the outer tear strip portion and the inner tear strip portion being stronger than the peelable bond between said at least part of the tear strip defined in one of the outer and inner laminate structures and an overlapping region of the other of the outer and inner laminate structures.

7. A package assembly as claimed in claim 5, in which the outer tear strip portion is not bonded to the inner tear strip portion, the lines of weakness in the outer laminate structure only extending part way through the outer laminate structure.

8. A package assembly as claimed in claim 5, in which at least one of the outer and inner tear strip portions has a longitudinal edge region which projects in a lateral direction of the tear strip beyond a corresponding edge of the other of the outer and inner tear strip portions to define a longitudinal edge region which overlaps a portion of one of the outer and inner laminate structures, the longitudinal edge region being bonded to the overlapping portion of said one of the outer and inner laminate structures in a peelable manner.

9. A package assembly as claimed in claim 5, in which the inner tear strip portion is narrower than the outer tear strip portion, the outer tear strip portion having at least one longitudinal edge region which projects beyond a corresponding longitudinal edge of the inner tear strip portion, the at least one longitudinal edge region being bonded to an underlying portion of the inner laminate structure in a peelable manner.

10. A package assembly as claimed in claim 9, in which each longitudinal edge of the outer tear strip portion projects beyond a corresponding longitudinal edge of the inner tear strip portion to define longitudinal edge regions on either side of the tear strip, both longitudinal edge regions being bonded to respective underlying portions of the inner laminate structure in a peelable manner.

11. A package assembly as claimed in claim 5, in which the inner tear strip portion is wider than the outer tear strip portion, the inner tear strip portion having at least one longitudinal edge region which projects beyond a corresponding longitudinal edge of the outer tear strip portion, the at least one longitudinal edge region being bonded to an overlying portion of the outer laminate structure in a peelable manner.

12. A package assembly as claimed in claim 11, in which each longitudinal edge of the inner tear strip portion projects beyond a corresponding longitudinal edge of the outer tear strip portion to define longitudinal edge regions on either side of the outer tear strip, both longitudinal edge regions being bonded to respective overlying portions of the outer laminate structure in a peelable manner.

13. A package assembly as claimed in claim 5, in which the inner tear strip portion is partially offset to one side of the outer tear strip portion, a longitudinal edge of the outer tear strip portion projecting beyond a corresponding longitudinal edge of the inner tear strip along one side of the tear strip to define a longitudinal edge region which is bonded to the underlying portion of the inner laminate structure in a peelable manner, a longitudinal edge of the inner tear strip portion projecting beyond a corresponding longitudinal edge of the outer tear strip along the other side of the tear strip to define a longitudinal edge region which is bonded to the overlying portion of the outer laminate structure in a peelable manner.

14. A laminated packaging wrapper for use in forming a package assembly as claimed in claim 1, the wrapper comprising an outer laminate structure and an inner laminate structure, the outer and inner laminate structures being bonded together in face to face relation, the wrapper having opening arrangement comprising a tear strip defined in the material, the tear strip having an outer tear strip portion defined in the outer laminate structure between two spaced outer lines of weakness in the outer laminate structure and at least one inner line of weakness in the inner laminate structure offset from the spaced outer lines of weakness, at least part of the tear strip defined in one of the outer and inner laminate structures being bonded to an overlapping region of the other of the outer and inner laminate structures in a peelable manner.

* * * * *